United States Patent [19]

Leeper

[11] Patent Number: 4,692,133

[45] Date of Patent: Sep. 8, 1987

[54] METHOD AND MACHINE TO FORM BOX PARTS

[75] Inventor: Alan L. Leeper, Nashua, N.H.

[73] Assignee: International Shoe Machine Corporation, Nashua, N.H.

[21] Appl. No.: 847,078

[22] Filed: Apr. 1, 1986

[51] Int. Cl.[4] ..... B31B 1/62

[52] U.S. Cl. ..... 493/128; 493/127; 493/141; 493/151; 493/183

[58] Field of Search ..... 493/111, 113, 128, 136, 493/140, 141, 143, 151, 156, 168, 123, 125, 127, 175, 178, 183

[56] References Cited

U.S. PATENT DOCUMENTS

| | | | |
|---|---|---|---|
| Re. 30,921 | 5/1982 | McDowell | 493/124 |
| 2,120,214 | 6/1938 | Gregoire . | |
| 3,013,477 | 12/1961 | Meger | 493/128 |
| 4,515,579 | 5/1985 | Beckett | 493/1 |
| 4,516,210 | 5/1985 | Dahlke | 493/136 |
| 4,553,954 | 11/1985 | Sewell et al. | 493/309 |

FOREIGN PATENT DOCUMENTS

| | | |
|---|---|---|
| 731322 | 6/1955 | United Kingdom . |

*Primary Examiner*—Frederick R. Schmidt
*Assistant Examiner*—Robert Showalter
*Attorney, Agent, or Firm*—Robert Shaw

[57] ABSTRACT

A machine to form an end of a unit of a box from a flat box blank that includes two sides, a bottom, and, at each end, an end flap supporting a cantilevered sealing tab, and two side tabs supported by the two sides. A planar movable table receives the box blank and a planar folding table receives the end flap and the sealing tab. A pair of side guides secures the two sides of the box blank and guide the box blank in its rearward travel. An end flap folding mechanism serves to fold the two side tabs attached to the box sides inward through ninety degrees to a position essentially parallel to the fold line. An adhesive applicator applies an adhesive ribbon in a predetermined pattern to the sealing tab and, sometimes, to the end flap. A drive mechanism folds the folding table from a position in which the plane of the folding table is in the plane of the movable table to a position in which the plane of the folding table is perpendicular to the plane of the movable table to fold the end flap through ninety degrees. A finger assembly consisting of a plurality of press fingers is disposed above and separated from the movable table. The press fingers have a planar bottom face and a planar back. The press fingers operate in pairs and are movable transversely to a position where the fingers of a pair are spaced from one another to another position wherein the press fingers of a pair are in close proximity to one another. Some of the finger assembly can be moved selectively transversely to accommodate various box widths.

28 Claims, 18 Drawing Figures

METHOD AND MACHINE TO FORM BOX PARTS

The present invention relates to machines for forming the lid and bottom of a box that may be used, for example, in the shoe or other footwear industry.

In this specification emphasis is placed on forming box parts, e.g., the lid and the bottom of a box, from a blank of the particular part for use in the shoe or other footwear industry. In this specification, the discussion is with respect, mostly, to shoe boxes, but the invention is broader.

A continuing problem in forming shoe box parts—the lid and the bottom—is differing box sizes, as well as differing material thicknesses as among boxes and differences in dimensions between the lid and the bottom of the box. At present, a change in box size requires that the machine forming the lid and the bottom of the box be manually changed to accommodate the new size. Typically this is done by changing jigs and fixtures of the machine.

Accordingly, it is an object of the present invention to provide a machine which can form box parts (i.e., a lid and a bottom) for a wide range of box sizes without the need to replace jigs and fixtures of the machine.

Another object is to provide a machine which is readily adapted to differing box sizes.

Another object is to provide a machine that provides square corners in the box parts made.

These and still other objects are addressed in the specification hereinafter.

The foregoing objects are obtained, generally in a machine for forming box parts that includes a planar movable table to receive a box blank; a feed mechanism positioned with respect to the movable table and operable to engage the box blank and to move the box blank rearwardly along the table surface to a point of register of the inside fold line of the box blank with the back of the table, the end flap, including the sealing tab moving, cantilever fashion, beyond the back of the movable table; a planar folding table to receive the end flap; a pair of side guides to secure side panels of the box blank and to guide the box blank in its rearward travel; end flap folding fingers that serve to fold those portions of the end flap attached to the box sides through ninety degrees to a position parallel to said fold line; an adhesive applicator adapted to apply adhesive to the sealing tab; a drive mechanism operable to fold the folding table from a position such that the plane of the folding table is in the plane of the movable table to a position such that the plane of the folding table is perpendicular to the movable table to fold in the end flap through ninety degrees; and a plurality of press fingers (or plates) disposed perpendicularly above and separated from the movable table at the back of the movable table, the back of the press fingers forming a surface which is parallel to said fold line and in the same plane as the fold line, the press fingers having a bottom face disposed parallel to the plane of the movable table, the press fingers being moveable transversely from an initial position wherein the press fingers are separated transversely from one another, adjacent press fingers being closed toward each other to a central position which assures that the sides of the formed box are perpendicular to the box bottom.

The invention is described hereinafter with reference to the accompanying drawing in which.

Figure 1:
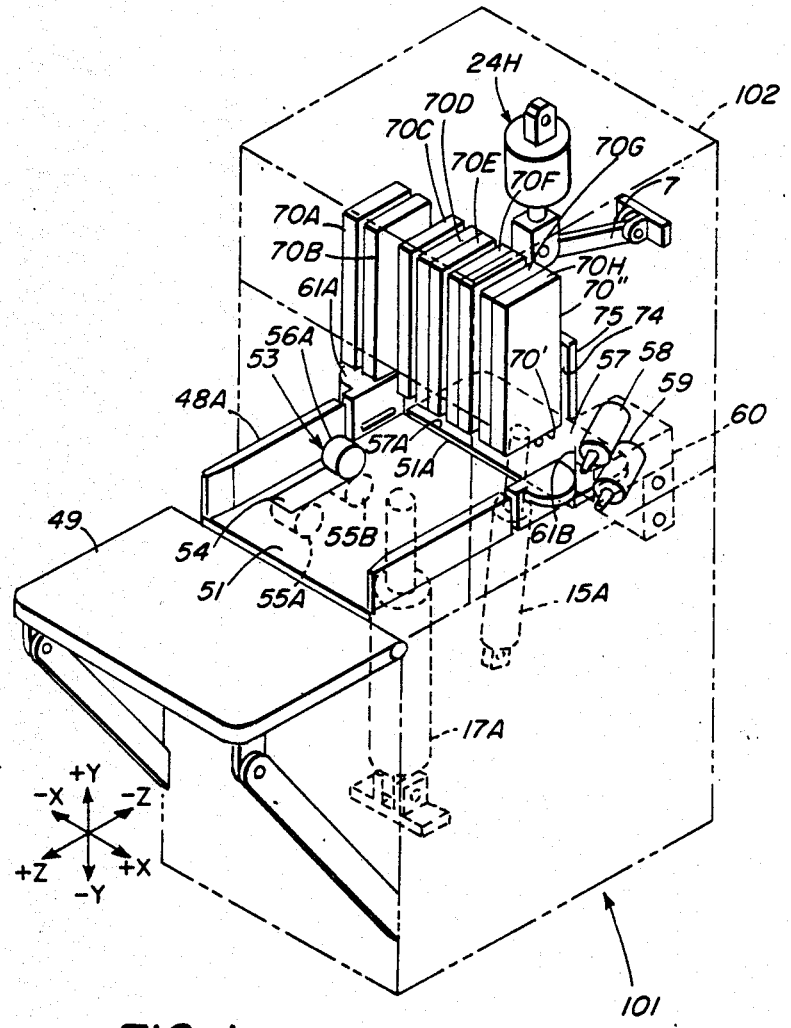
FIG. 1 is an isometric view of a general form of the mechanical and pneumatic structures of the present invention can take and includes nine press fingers.

Turning now to FIG. 1, there is shown at 101 a machine for forming the lid and the bottom of a particle board or pressboard or the like box. As explained below, the machine 101 forms first one end of a lid, for example, from a lid blank and then forms the outer end of that lid. For any particular shoe box, the box lid is more shallow than the bottom of the box and slightly larger in cross dimensions. The forming of the lid is almost identical to the forming of the bottom except, as noted below, generally adhesive is applied to one part of the lid, but to two parts at each end of the bottom of a box. In what follows emphasis is placed on forming a box lid, to simplify the explanation.

In the explanation below, the machine operator is intended to stand to the left of the machine 101 looking in the minus Z-direction. Directions extending toward the operator (i.e., plus Z-direction) will be regarded as "forward" and directions extending away from the operator will be designated as "rearward". The front of the machine 101 is closest to the operator and the back of the machine is furthermost from the operator. The X-Z plane is horizontal. The table labeled 49 is optional and, in fact, is not being used in the first embodiment of the machine 101, as is evident from the later figures. FIG. 1 is particularly useful because it shows positions of the important aspects of the present invention. Many of the other structures shown in the remaining figures are shown to disclose an operative device.

Figure 3:
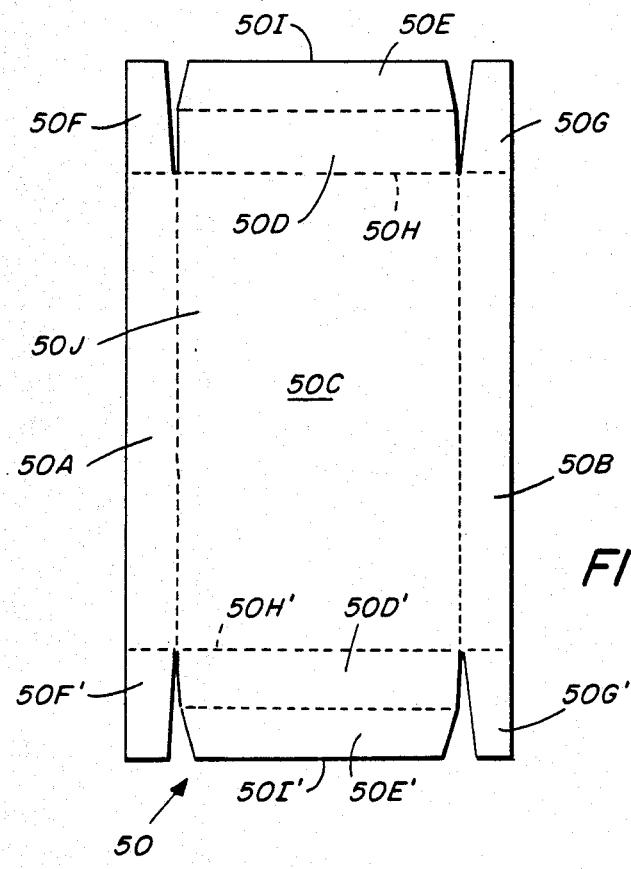
FIG. 3 is a plan view of a box part blank (e.g., a lid)

The machine 101 is employed to form an end of a unit (e.g., the lid) of a box from a flat blank 50 in FIG. 3 consisting of two sides 50A and 50B and a blank bottom 50C. At each end of the blank 50 there is an end flap 50D (and 50D') supporting a cantilevered sealing tab 50E (and 50E') and two side tabs 50F (and 50F') and 50G (and 50G') which extend from and are supported by the two sides 50A (and 50A'), respectively. The connection marked 50H (and 50H') between the end flap 50D (and 50D') and the blank bottom 50C constitutes a fold line, as later discussed.

Figure 7:
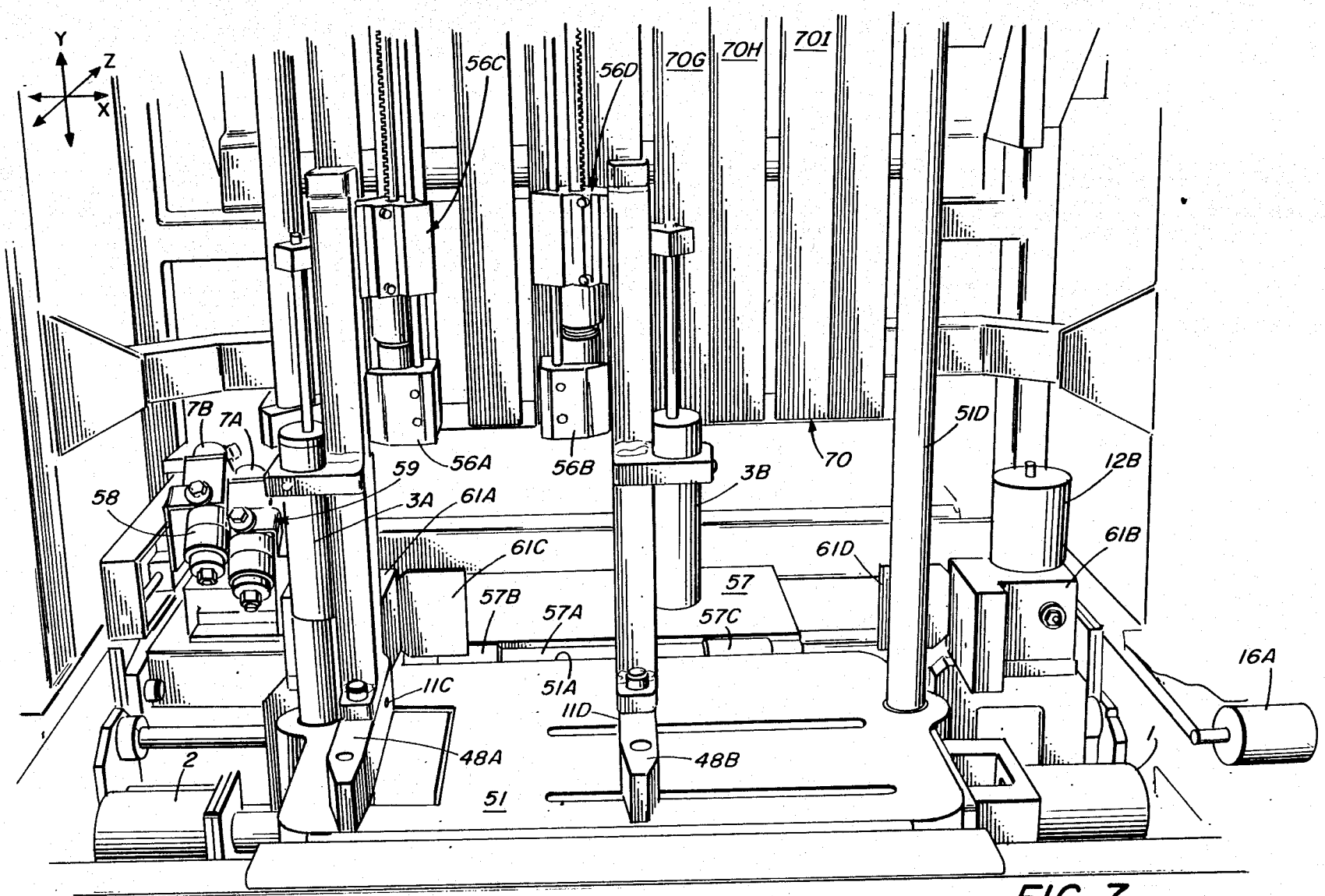
FIG. 7 is a front isometric view of a slight modification of the machine in FIG. 1 and includes the press fingers of FIG. 1.
Figure 8:
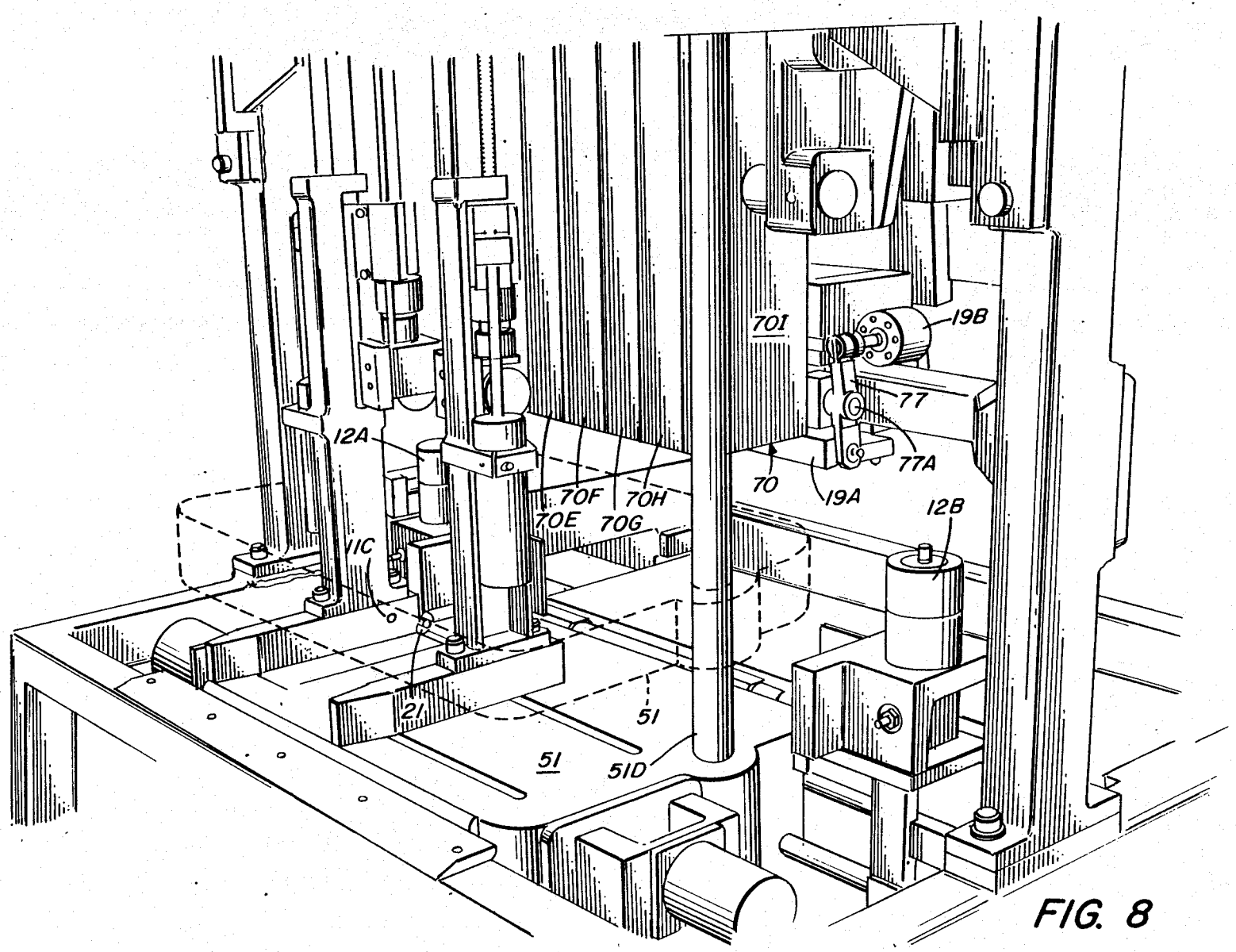
FIG. 8 is an isometric view of the machine of FIG. 7 taken from the right, front side of the machine in FIG. 7.
Figure 9:
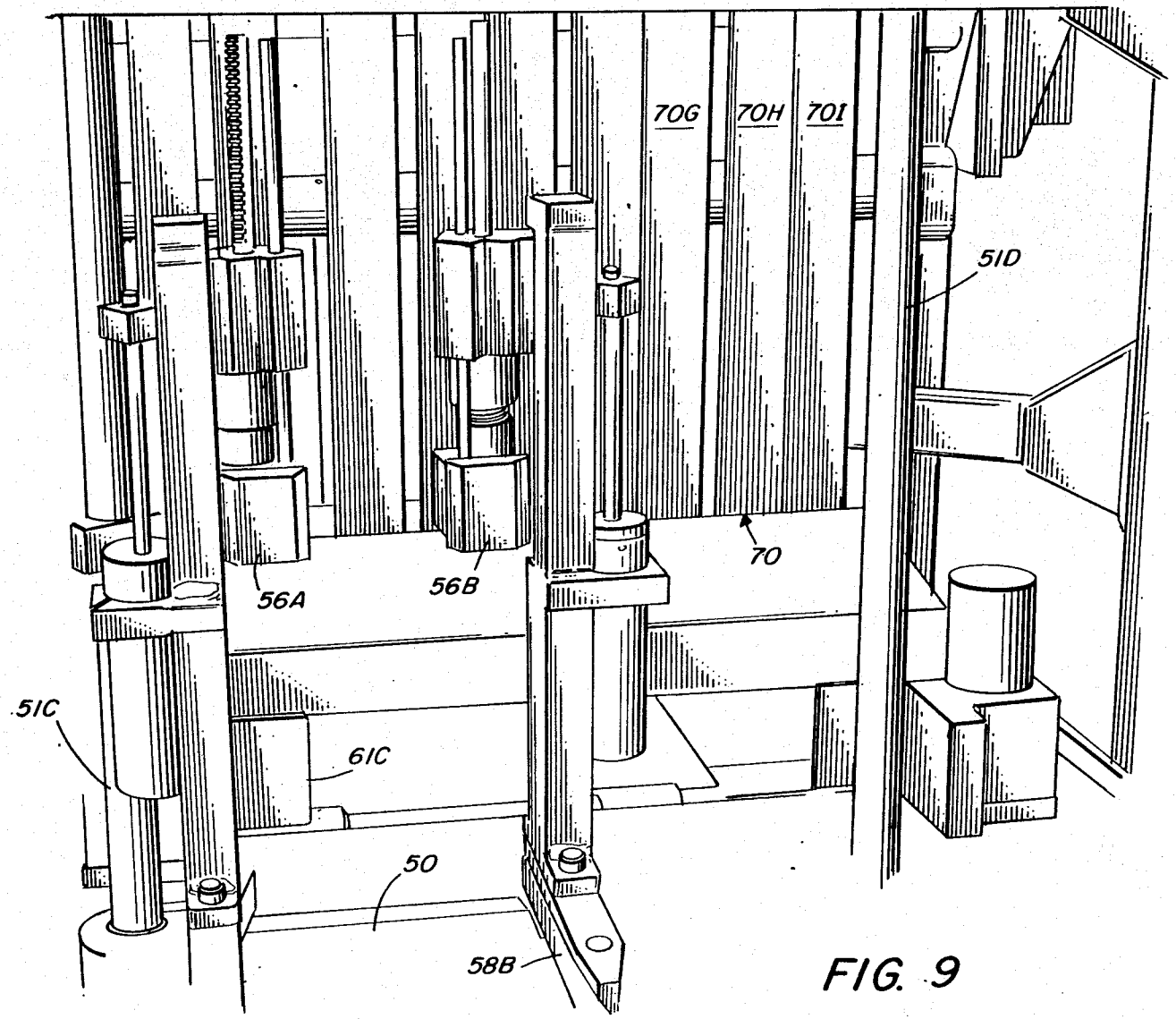
FIG. 9 is a front isometric view of a portion of the machine in FIG. 7.
Figure 12:
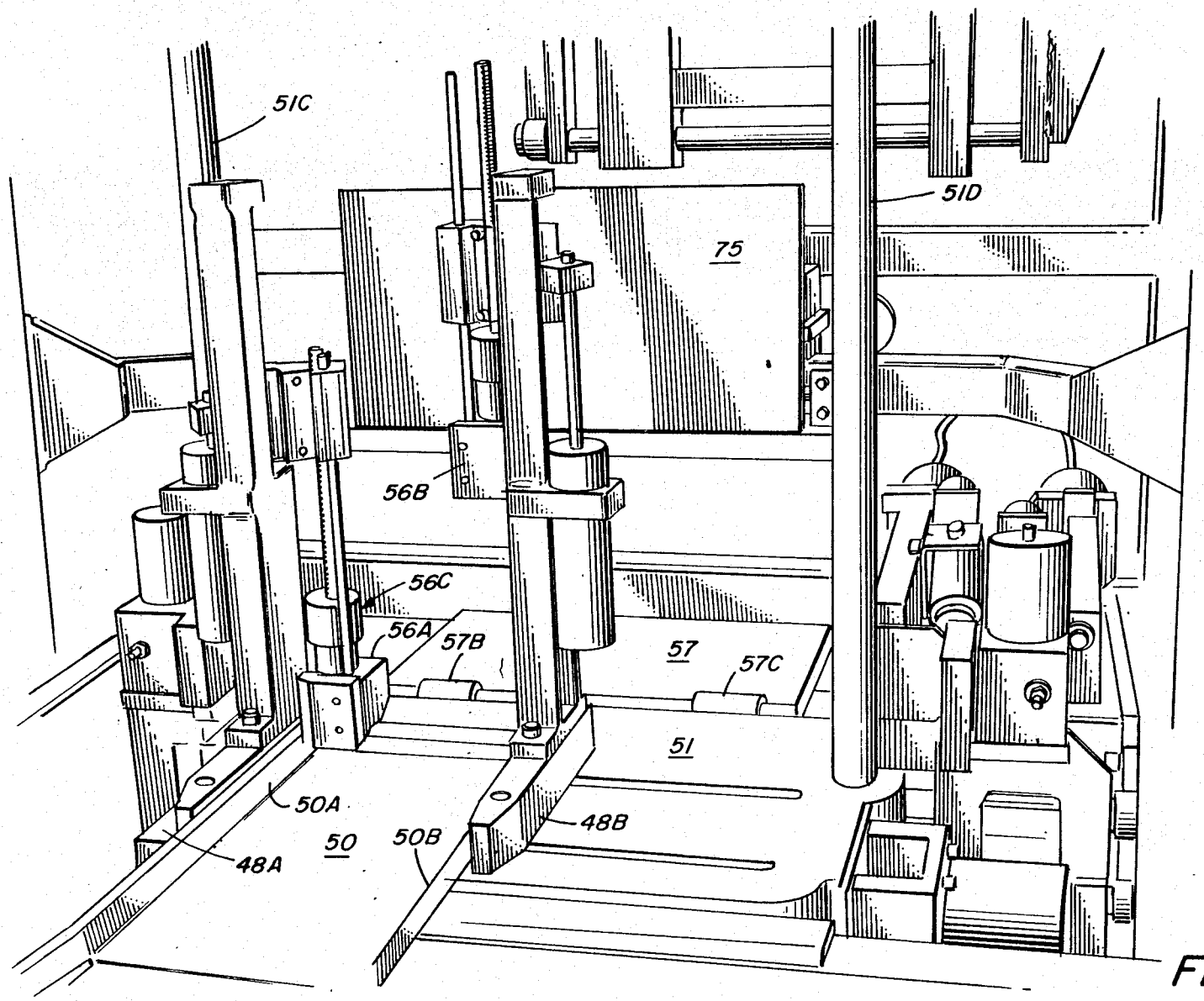
FIG. 12 is an isometric view of the machine taken to the right of the view in FIG. 11.
Figure 13:
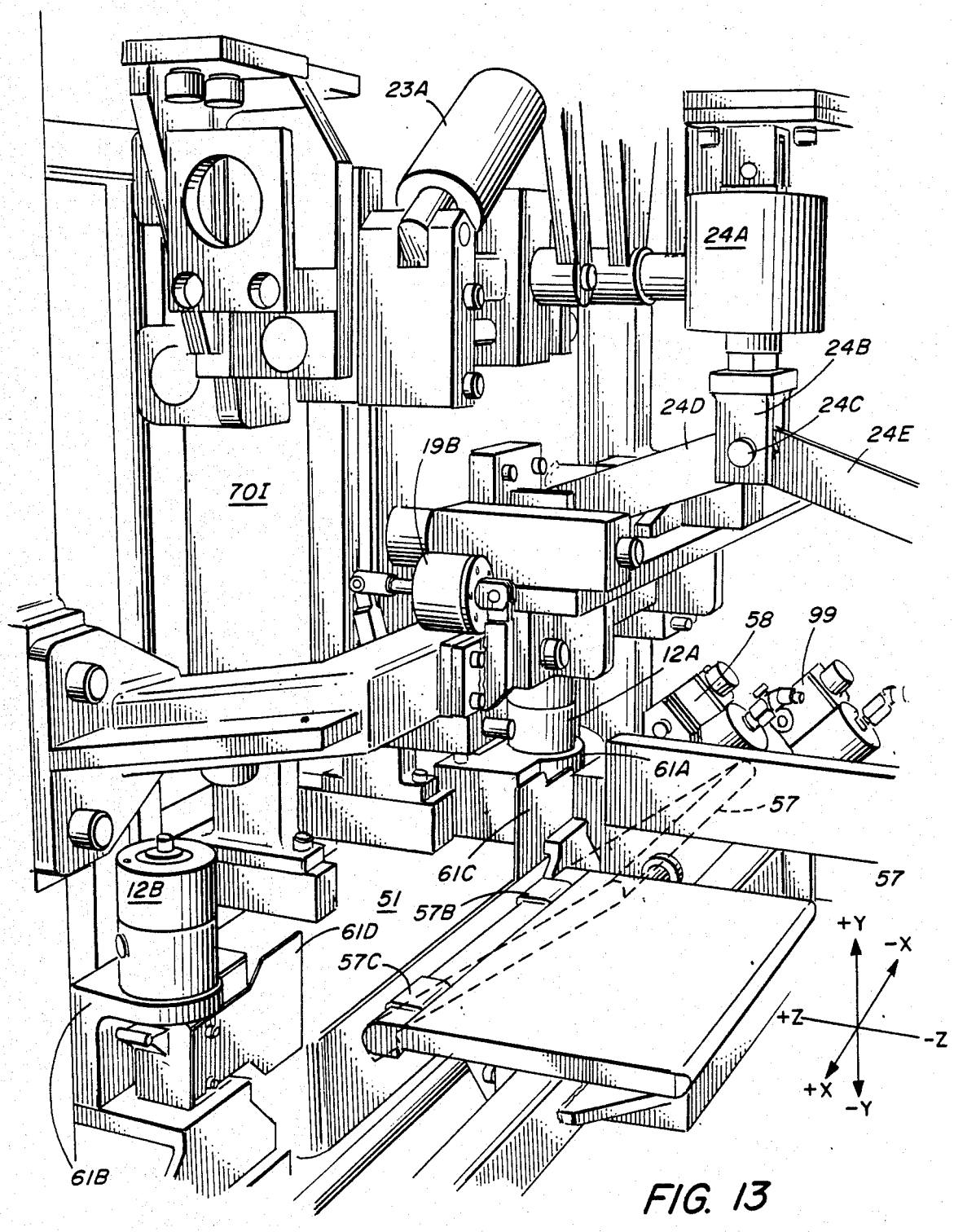
FIG. 13 is an isometric view of the machine in FIG. 7 taken from the right, back side of the view in FIG. 7.
Figure 14:
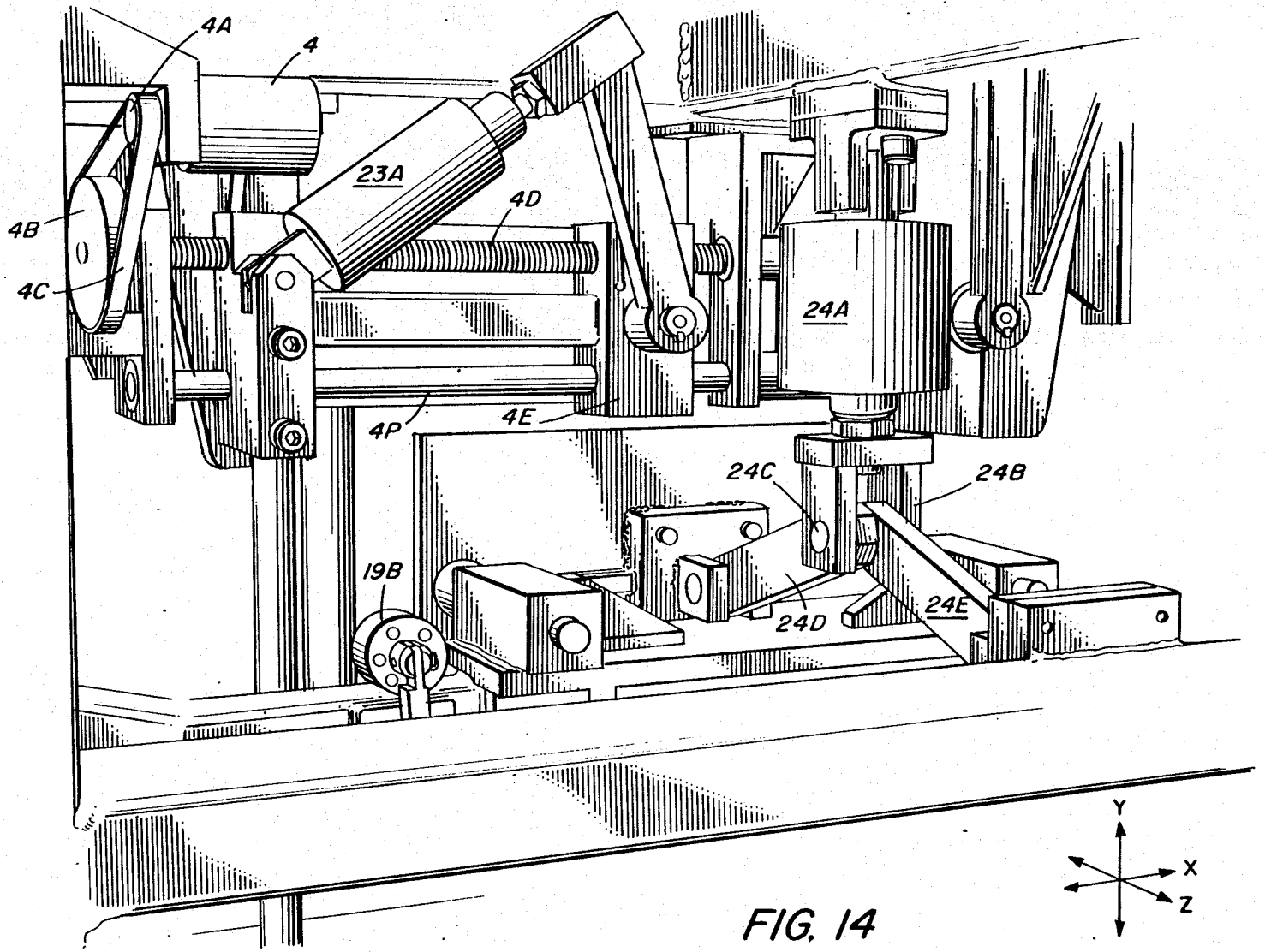
FIG. 14 is an isometric view taken to the right and above of the view in FIG. 13.
Figure 15:
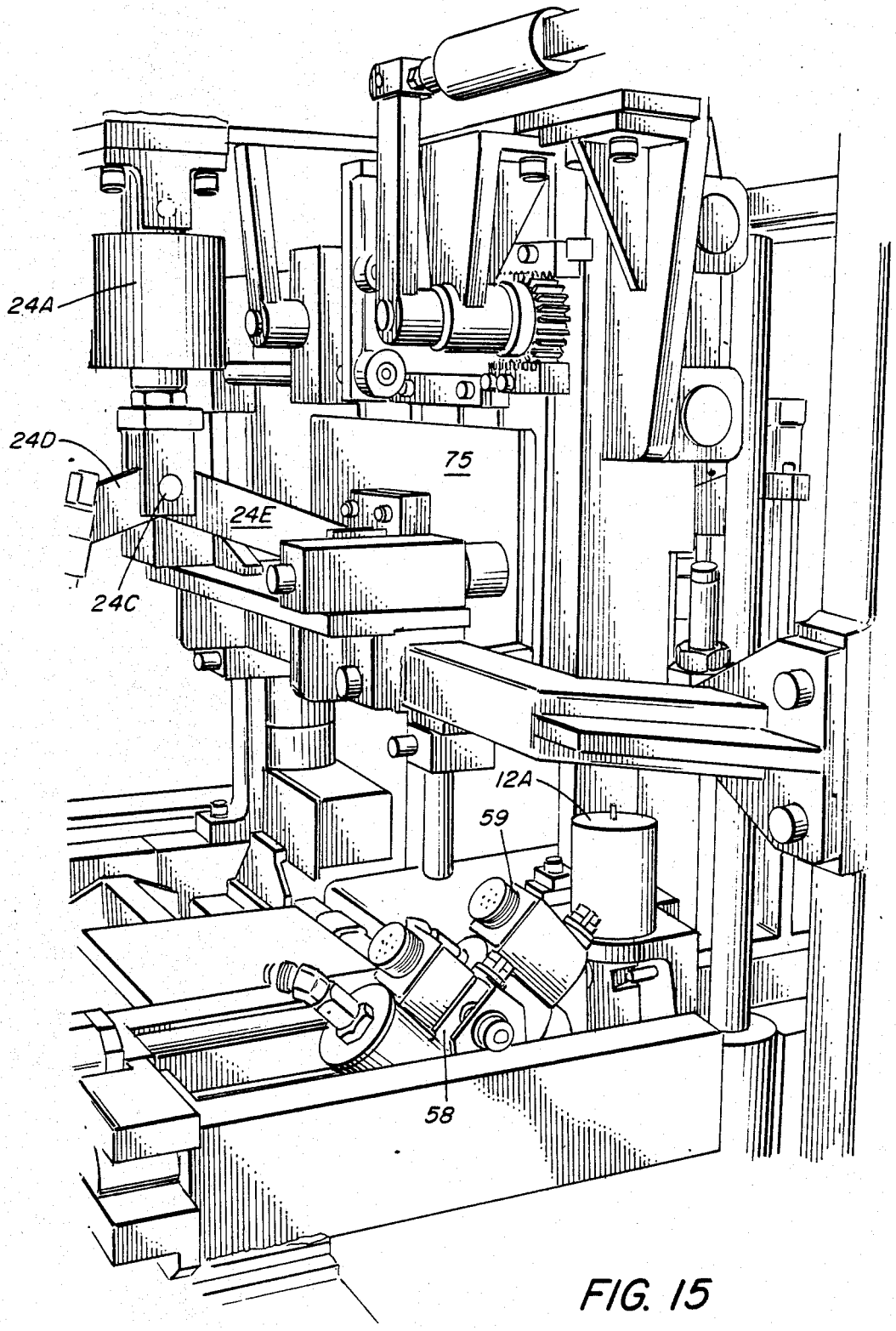
FIG. 15 is an isometric view taken from the left, rear of the machine in FIG. 7.

The machine 101 includes a planar movable table 51 to receive the box blank 50 in FIGS. 1, 8, 9, etc. The movable table 51, as later shown, is moved up and down (±Y-direction) in FIG. 1 by an air cylinder 17A. A feed mechanism 53 includes a continuous loop belt 54 positioned to coincide with the X-Z plane of the table 51; the belt 54 is operable to engage the underside of the box blank 50 and to move the box blank 50 rearwardly along the table surface. More specifically, the belt 54 is driven by pulleys 55A and 55B that are rotated clockwise in FIG. 1 by a stepping motor 2 in FIG. 2 (and other figures) to achieve the clockwise rotation noted. A spring-loaded nip roll 56A in FIGS. 1 and 7 presses down on the upper side 50J of the box blank, pressing the box blank downward onto the belt 54. (See also another, right side nip roll 56B in FIG. 7 that performs a similar function; the respective nip roll assemblies are labeled 56C and 56D in various figures.) In this way the box blank 50 is engaged and is moved rearwardly along the table surface to a point of register of the fold line 50H of the box blank 50 with the back labeled 51A of the table 51. The end flap 50D and the sealing tab 50E move cantilever fashion beyond the back 51A of the movable table. A pair of end flap folding mechanisms 61A and 61B (see FIG. 7) have flaps 61C and 61D that fold the side flaps 50F and 50G respectively clockwise and counterclockwise through ninety degrees. A planar folding table 57 receives the end flap 50D and the sealing tab 50E. The folding table 57 can fold counterclockwise in FIG. 1 by an air cylinder 15A about its forward end 57A, as later discussed. Prior to that happening, adhesive guns 58 and 59 which are mounted on a carriage 60 are driven in the minus X-direction from where they are at the right side of the machine 101 toward the left side thereof (e.g., FIGS. 6 and 9). In the course of travel, a hot-melt adhesive is deposited on the sealing tab and, depending on the depth of the box part being formed, on the end flap 50D. Only then is the folding table 57 folded (e.g., FIG. 12) to move the end flap and sealing tab through ninety degrees.

Figure 5:
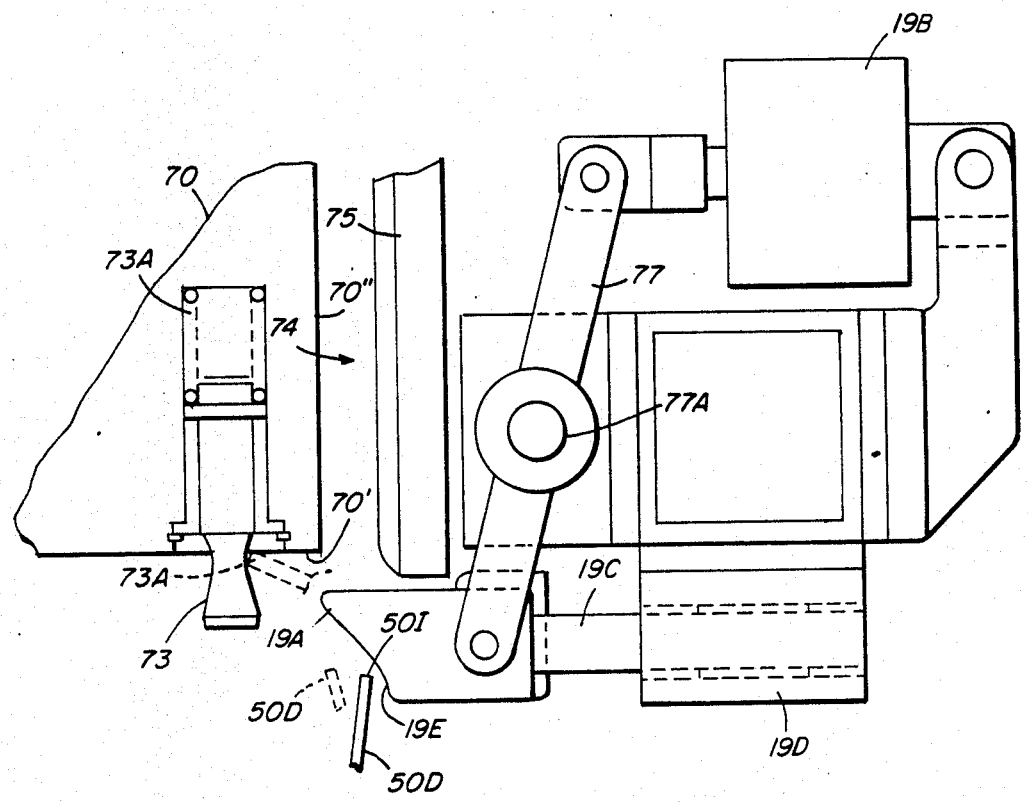
FIG. 5 is an elevation view of a deflection bar and closely related apparatus plus a partial view of the press finger mechanism of FIG. 1.

At this juncture, the movable table 51 is moved upward (see the dotted position in FIG. 8) in the plus Y-direction in FIG. 1. A tab deflection device 19A in FIG. 5 is engaged by the free end labeled 50I (and 50I') of the sealing tab, causing the tab to bend at a fold line 50K (and 50K') and to engage the underside shown at 70' of a finger assembly 70 (see FIG. 5) that includes datum-end press fingers 70A and 70B and transversely adjustable press fingers 70C–70I, as now explained, mostly with reference to FIG. 1.

The fingers 70A–70I are rectilinear plates (see FIG. 4) whose length dimension is vertically oriented (i.e., in ±Y-direction). The flat underside of the fingers 70A–70I is designated 70' and the flat back side is labeled 70''. The datum end fingers 70A and 70B function as a pair, as explained below, to receive and press the left side 50A during later operations in the forming procedure. The transversely-adjustable press fingers 70C–70I also operate in pairs, but there are seven such fingers; so the members of a pair change, as explained below.

Figure 4:
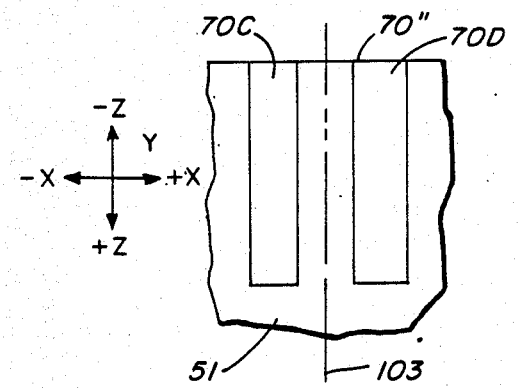
FIG. 4 is a plan view showing two of the press fingers in FIG. 1.

Later it is shown that the fingers 70C–70I can be moved transversely (i.e., ±X-direction) of the table 51 to register the center line between a pair of fingers—such as the line labeled 103 in FIG. 4 between the fingers 70C and 70D—with the folded side 50B. In later operations the fingers of a pair (e.g., 70C and 70D) are moved toward each other and toward the center line 103 to press the folded side 50B securely therebetween; the fingers 70A and 70B are similarly moved to secure the folded side 50A, whereby the sides are 50A and 50B of the box unit being formed are held securely in a vertical position while the end parts of the box unit (e.g., the lid) are being adhered together. In this way a box unit is formed with sides perpendicular to the bottom and to the end, that is, the box unit has square corners as demanded by the shoe industry, yet box forming costs are within acceptable limits.

As above indicated, the fingers 70C–70I operate in pairs, but except for the fingers 70C and 70I, the members of a pair can change. For example, the finger 70D in FIG. 4 is in cooperation with the finger 70C, but for other width boxes, the fingers 70D cooperates with the adjacent finger 70E to receive a side 50B of a wider box. It is noted elsewhere herein that the fingers in the machine 101 need never move transversely more than half a finger thickness to accommodate a particular width box. This is so because if movement is required of a particular finger pair, e.g., the finger pair 70C–70D, to accept a different width box, then the finger pair 70D–70E, for example, might be used (assuming that the box size is slightly larger than that accommodated by the finger pair 70C–70D). Successively larger box sizes would be successively formed using the finger pairs 70C–70D (first), 70D–70E, 70E–70F, 70F–70G, 70G–70H, and 70H–70I. One further point of explanation should be made to clarify the above; when the finger 70D moves away from the finger 70C it moves toward the finger 70E which simultaneously is moving toward the finger 70D; when the finger 70D moves toward the finger 70C, it moves away from the finger 70E. Transverse adjustment of the fingers 70C–70 can be in viewed as adjustment of the center line 103 between adjacent fingers. The fingers 70A and 70B do not move in the adjustment and have a separate mechanism to cause them to close toward the centerline therebetween and to open away from that center line, as explained later.

As noted above, the movable table 51 with the box blank 50 thereon is moved upwardly (see FIG. 8) along cylindrical shafts 51C and 51D with the end flap 50D and the sealing tab 50E bent ninety degrees to be vertically oriented and the two side tabs 50F and 50G folded through ninety degrees toward each other; adhesive has been applied and the adhesive applicators have been moved out of the active region of the machine. As the movable table 51 moves upward the edge 50I in FIG. 5 of the sealing tab 50E strikes the arcuate surface 19E of the tab deflector bar 19A in FIG. 5, which has been moved into place for that purpose, as later discussed. The edge 50I is folded slightly to strike the bottom 70' of the finger assembly 70, at which time the deflector bar 19A is withdrawn. The movable table 51 continues to rise, pressing the edge 50I against a plurality of spring-loaded dowel-like pin members 73 (one only is shown in FIG. 5) that extend downward about a half-inch below the underside 70' of the finger assembly 70.

In this way the sealing tab 50E is folded toward the end flap 50D. As upward movement in the direction of arrow A in FIG. 6 continues, the folded sealing tab 50E (see FIG. 6) moves into the space marked 74 between the back side 70" of the finger assembly and a press plate 75. Upward movement in the direction of the arrow A in FIG. 6 continues until the blank bottom 50C is in close proximity to, but not touching, the underside 70' of the finger assembly 70. At this juncture two pairs of fingers, which have been open (see the explanation elsewhere herein) to receive the sides 50A and 50B close, to square the sides of the now-folded end of the box blank with respect to the other parts thereof. Then a toggle press air cylinder 24A is actuated to press the toggle press plate 75 toward the back 70" of the finger assembly 70, reducing the space 74 to press the folded sealing tab 50E (with adhesive thereon) securely toward the inside of the end flap 50D with the tabs 50F and 50G therebetween. This is what occurs when the lid of a shoe box is formed. When it is the deeper shoe box bottom that is formed, adhesive segments are applied also to the end flap 50D to adhere that end flap to the side tabs 50F and 50G at locations spaced downwardly from the sealing tab. Then the blank, formed at one end, is removed. To achieve removal the fingers that had been closed are opened, the table 51 is moved downward, the rollers 55A and 55B are raised (as discussed below). The direction of travel of the belt 54 is reversed to cause the blank to move forward toward the front of the machine. The blank 50 is reversed and the opposite end of the box is formed, as before. In the further figures the machine illustrated is very similar to the machine 101 but is not identical thereto. For example, the table extension shown at 49 in FIG. 1 does not appear in the later figures and further machine parts necessary to the functioning of the machine 101 in FIG. 1—but not shown there to render FIG. 1 more easily understandable with respect to the more vital parts—are shown in the later figures. The label 102 in FIG. 1 represents a metal cover; side guides 48A and 48B receive the box blank 50 with the sides 50A and 50B folded, as is shown in later figures and discussed below.

As noted above, the fingers 70A–70I act in pairs. The fingers 70A and 70B, called datum end fingers herein, cooperate to press the left side of the formed blank 50 together in the formation of one end of the finished products such as, for example, a box lid. The machine 101, as above noted, forms a box lid as well as a box bottom, the difference between the two being depth; a box lid typically is about one inch deep, the box bottom is up to five or six inches deep. To simplify the remainder of this explanation, the discussion will be mostly with respect to the box lid.

One of the last steps in lid formation is that noted in the previous paragraph. The sealing tab 50E has been folded inwardly of the lid to sandwich the side tabs 50F and 50G between the sealing tab 50E and the end flap 50D. At that juncture the fingers 70A and 70B are brought together with the lid side 50A therebetween; and two other fingers, depending on the width of the lid, are brought together with the lid side 50B therebetween. Then the toggle press plate 75 is moved toward the back 70" of the fingers, pressing the end parts of the lid toward one another with significant force to adhere all the parts so squeezed (pressed) together. The adhesive is a hot melt adhesive used in the shoe industry, which solidifies very rapidly at some threshold temperature. That occurs and the end of the lid is formed. Then the lid is removed, as above noted, and the lid is reversed to form the other end thereof. The remainder of this specification is devoted mostly to a discussion of the particular functioning units to achieve the functions discussed above, first with reference to FIG. 2.

Figure 2:
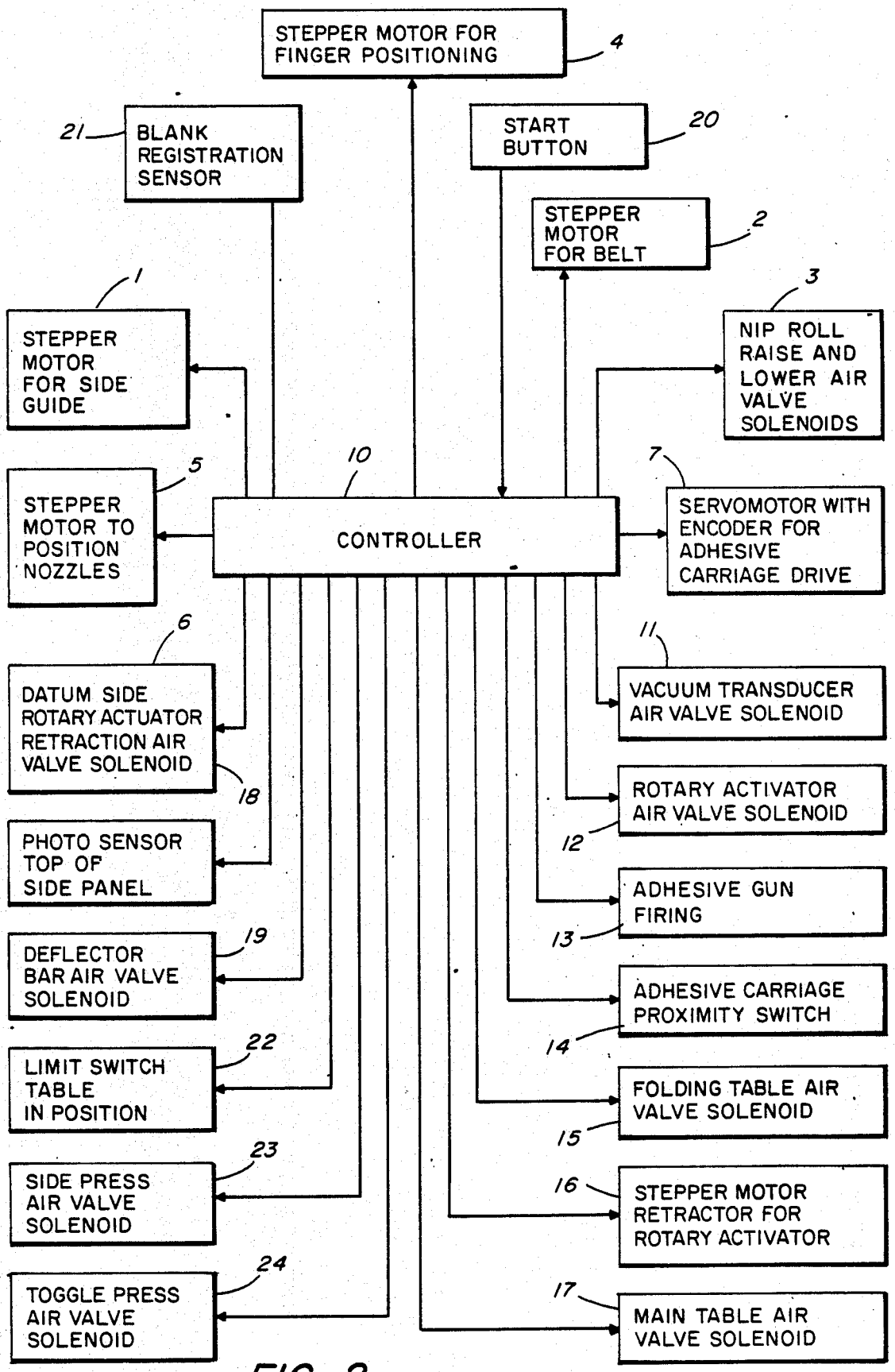
FIGS. 2 and 2A are respectively a diagrammatic representation of parts of the machine in FIG. 1 and a flow chart.
Figure 2A:
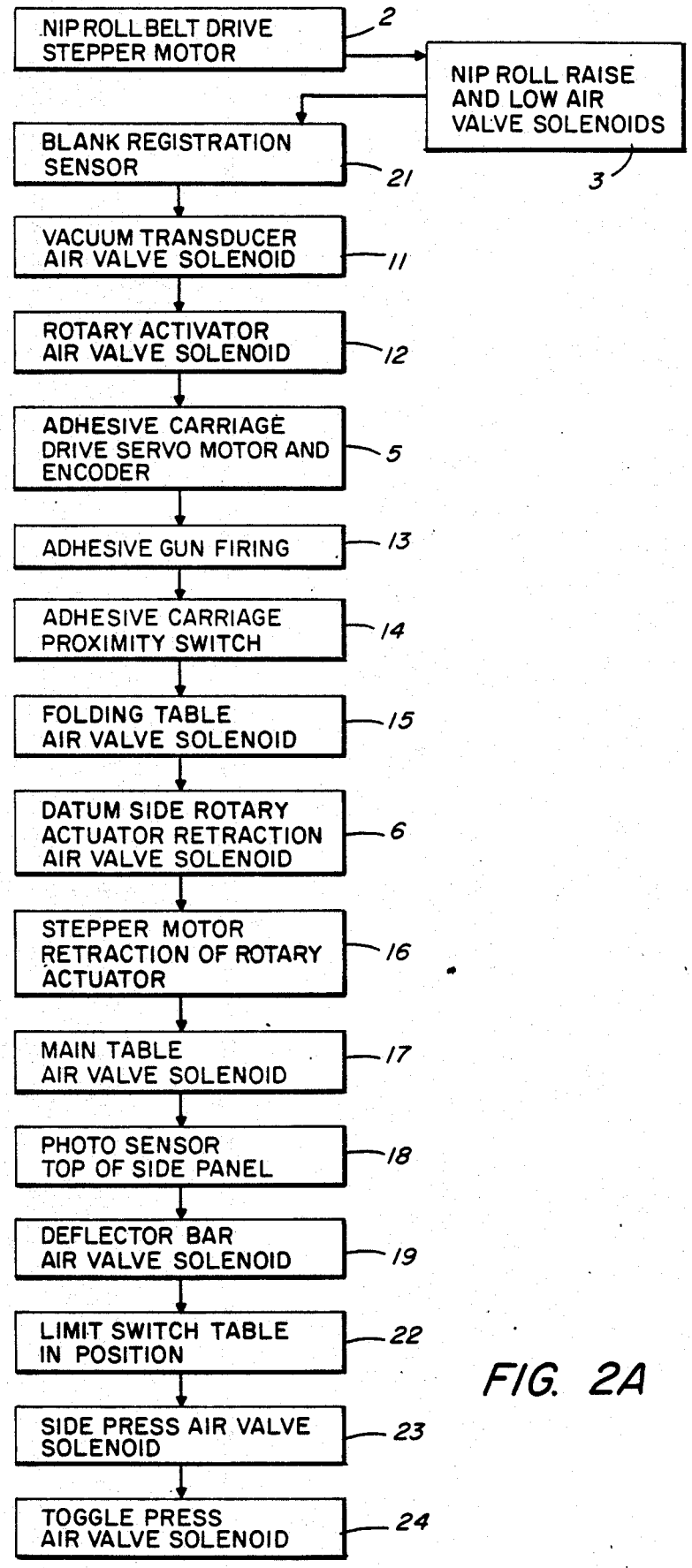
Figure 10:
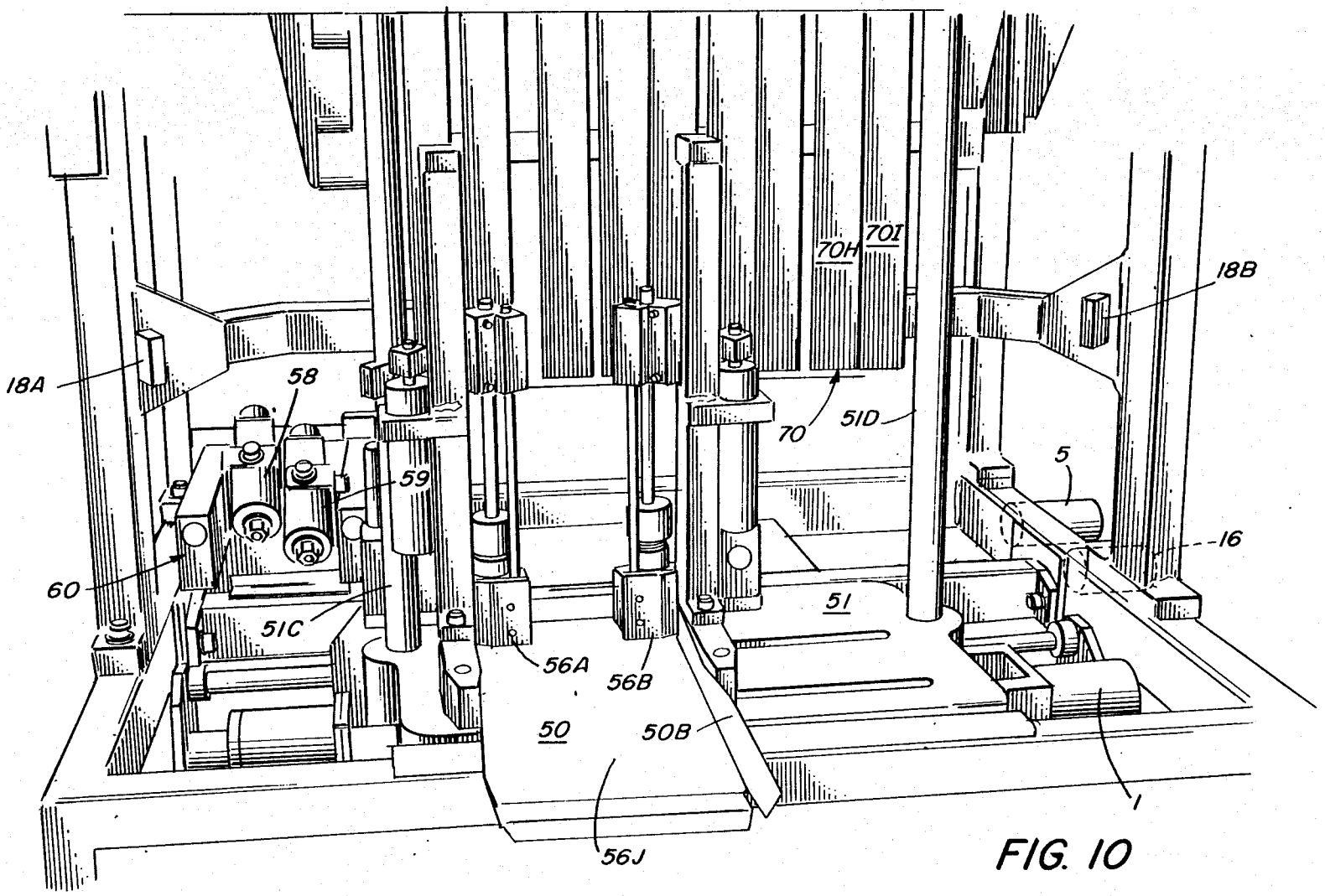
FIG. 10 is a front isometric view of a portion of the machine in FIG. 7.
Figure 11:
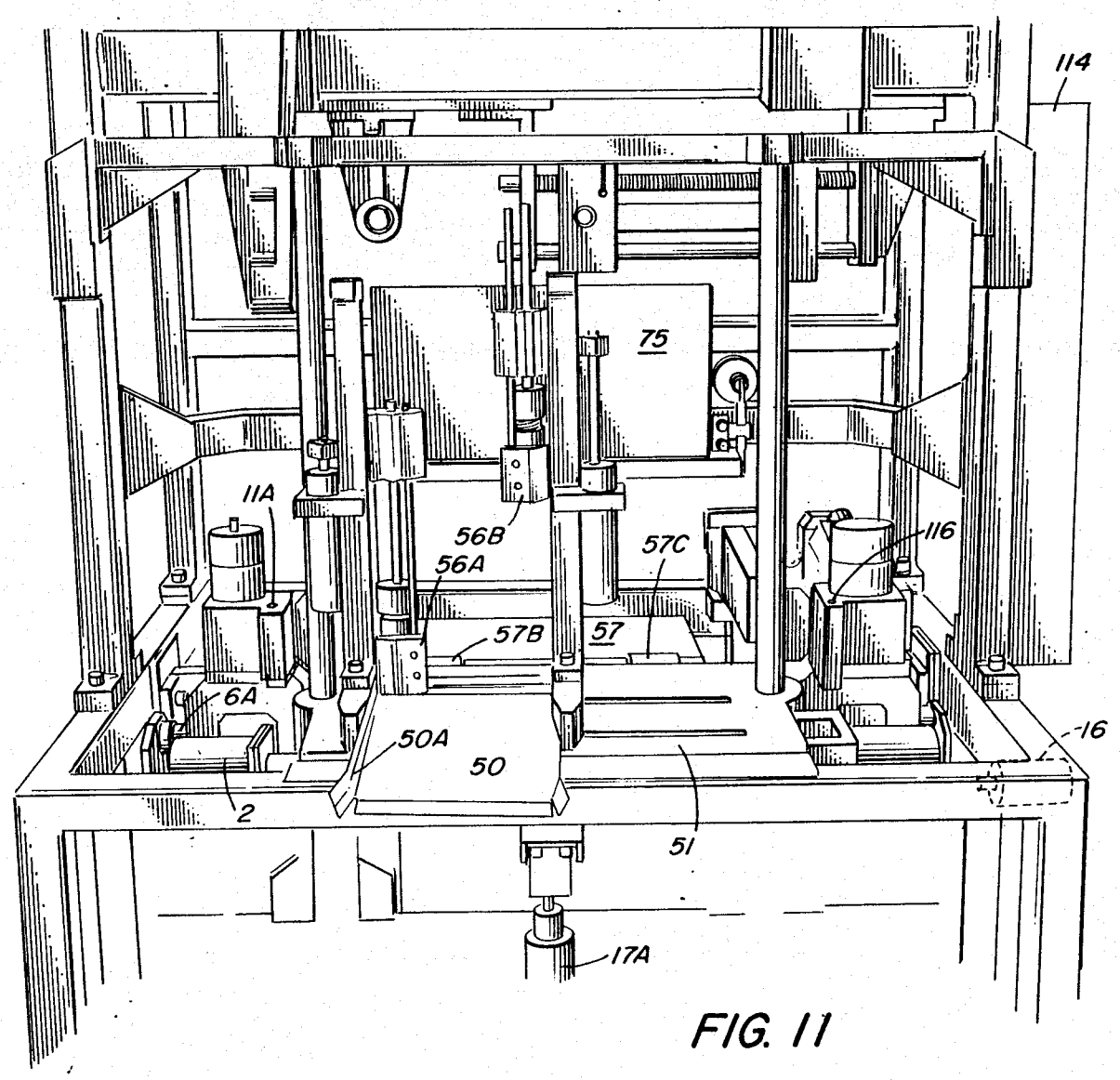
FIG. 11 is an isometric view, like FIG. 10, but without the press fingers.
Figure 16:
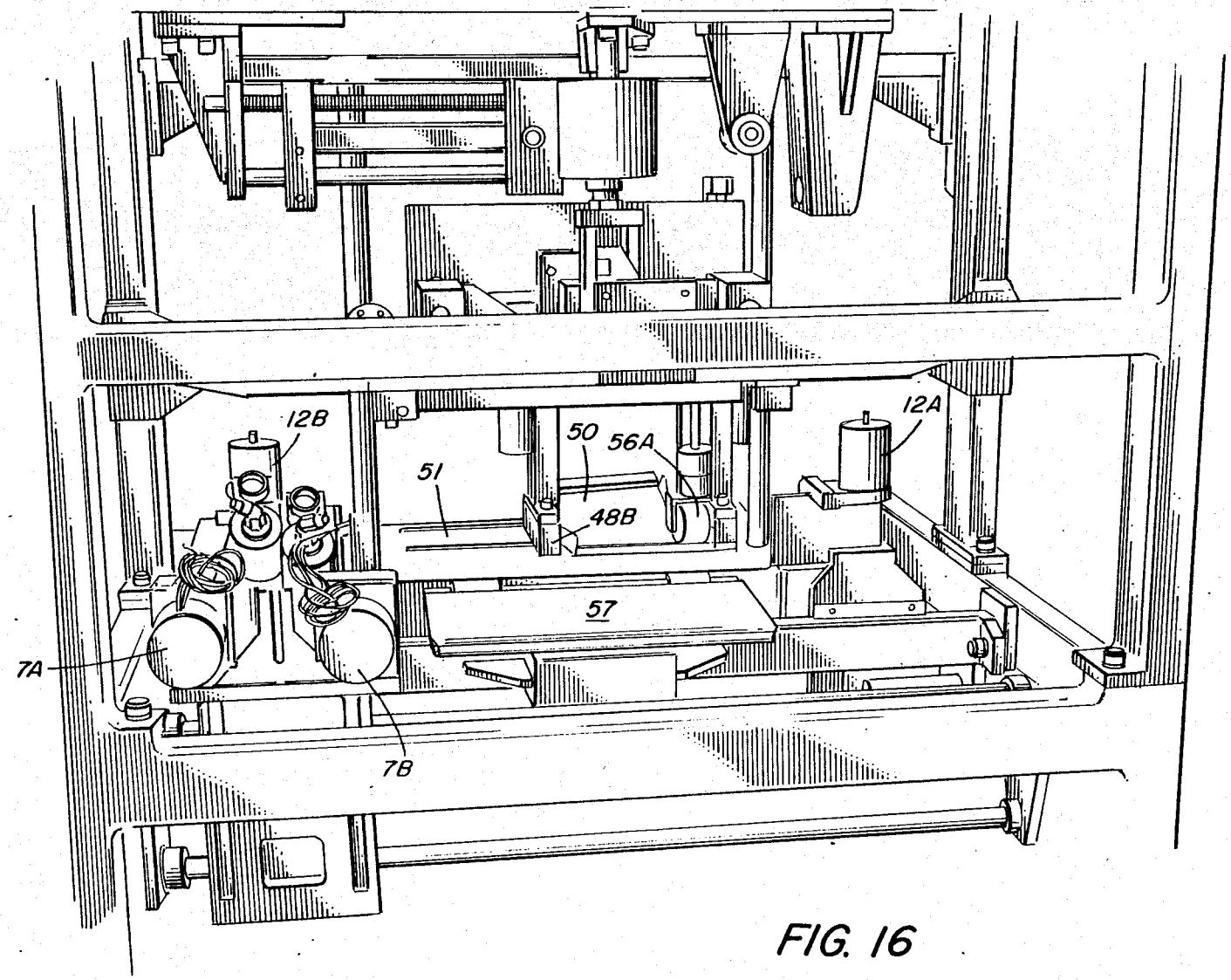
FIG. 16 is an isometric view from the rear and slightly to the left of the machine of FIG. 7.

The explanation in this and the next paragraph is related mostly to the diagrammatic representation in FIG. 2 which includes a controller 10 that includes a microprocssor. The explanation here is augmented by sequencing blocks in FIG. 2A in which corresponding blocks have the same labels as in FIG. 2 and both figures are augmented by the listing later, in PASCAL source code, of the iterative steps to be accomplished by one cycle of the machine 101 in FIG. 1. As is noted in the PASCAL listing, the first step in the formation of a box part (or unit) such as, for example, a lid, is the "operator loads a box with sides folded up" and, then, the "operator pushes start button" 20 in FIG. 2. At that point the controller 10 takes over, energizing the belt stepper motor 2 which drives the belt 54 in the figures to engage the box blank 50, the belt 54 being operable to engage the underside of the box blank 50 and to move to box blank rearwardly (i.e., in the minus Z-direction in FIG. 1) along the surface of the movable table 51 to a point of register of the inside fold line 50H of the box blank 50 with the back 51A of the table 51. The end flap 50D, plus the sealing tab 50E, moves cantilever fashion beyond the back 51A of the movable table 51 and onto the planar folding table 57. At this juncture the tops of the tables 51 and 57 are in a common plane and the fold line 50H of the box blank 50 registers with the back 51A of the table 51. The mechanism by which such registration is achieved includes, as later discussed, an air sensor or blank registration sensor 21 in FIGS. 2 and 8 (e.g., an air sensor) acting through the controller 10, to establish a predetermined number of steps of the stepper motor 2 which for the box part being formed causes the fold line 50H to stop at the end 51A of the table 51. (At this juncture it should be pointed out the various important dimensions of each box blank to be formed have been earlier determined and the dimensions have been converted to steps of the various stepper motors noted in FIG. 2 and elsewhere. Thus, a number of steps of a particular stepper motor will effect a distance movement in the machine 101.) At that point (i.e., when registration is achieved between the fold line 50H and the back 51A of the table 51) a vacuum transducer air valve solenoid 11 is actuated to draw a vacuum at holes 11A and 11B in FIG. 11 and thence two apertures 11C and 11D in FIG. 7, for example, to hold the sides 50A and 50B in position relative to the guides 48A and 48B. Then two rotary actuator air valve solenoids 12 in FIG. 2 are energized to actuate valves 12A and 12B in FIG. 7, thereby to activate the side tab folding flaps 61C and 61D (FIG. 7) in the elements 61A and 61B in FIG. 1; each of the elements 61A and 61B includes a rotary air activator and a planar contact, i.e., the flaps 61C and 61D, that engages a side tab, e.g., the side tab 50F, and presses it to rotate through 90 degrees into a plane parallel to the plane of the back of the finger assembly 70. As later explained the two adhesive heads 58 and 59 have been pre-positioned, sometimes into position to apply adhesive to the sealing tab 50E alone and, sometimes, to the sealing tab 50E and the end flap 50D. Typically the adhesive is applied as a hot-melt ribbon across the sealing tab 50E but as ribbon segments to the end flap 50D, being applied only the length (or less) of the side tab length on the end flap 50D. The adhesive guns 58 and 59 are positioned longitudinally by stepper motors 7A and 7B in FIG. 16; the adhesive carriage 60 in FIGS. 1 and 10 is driven by a servomotor and encoder 5 in FIGS. 2 and 9. When the adhesive guns 58 and 59 reach a predetermined transverse position, one or both are energized to squirt adhesive onto the box blank (when a shallow box part such as a lid is being formed, the gun 58 only is fired). The adhesive, as above noted, is hot melt and changes state very rapidly when its change-of-state temperature is reached. Adhesive gun firing is achieved by circuitry in the adhesive gun firing block marked 13 in FIG. 2. An adhesive carriage proximity switch 14 functions to terminate movement transversely of the adhesive heads relative to the box blank 50. At that juncture a folding table solenoid 15 is actuated by the controller 10; this activates the air cylinder 15A which is interconnected to fold the folding table 57 from a position such that the plane of the folding table is parallel to the plane of the movable table to a position perpendicular to the movable table to fold the end flap 50D through ninety degrees. Then a rotary activator retraction air valve solenoid 6 is activated to retract the activator 61A; the activator 61B is retracted from the active volume of the box forming machine 101 by a stepper motor 16A in FIG. 7, which is activated by controls 16 in FIG. 2. Then the movable table air valve solenoid 17 is actuated to activate the air cylinder 17A to raise the movable table 51 upward toward and into close proximity of the bottom face 70' of the press fingers 70. The deflector bar 19A in FIG. 5, as before noted, deflects the sealing tab 50E beneath the bottom face 70' as the movable table 51 is raised. The toggle press plate 75 is disposed parallel to and slightly separated from (see the separation 74 in FIG. 1 and other figures) the back 70'' of the press fingers such that the sealing tab 50E, now folded toward the inner surface of the side tabs 50F at 50G, captivates the side tabs 50F and 50G, once the toggle plate 75 is moved forward, between the sealing tab 50E and the end flap 50D (See FIG. 6 which illustrates the way the sealing tab 50E, the side tab 50G and the end flap 50D are formed as they move in the direction of the arrow A.)

Figure 17:
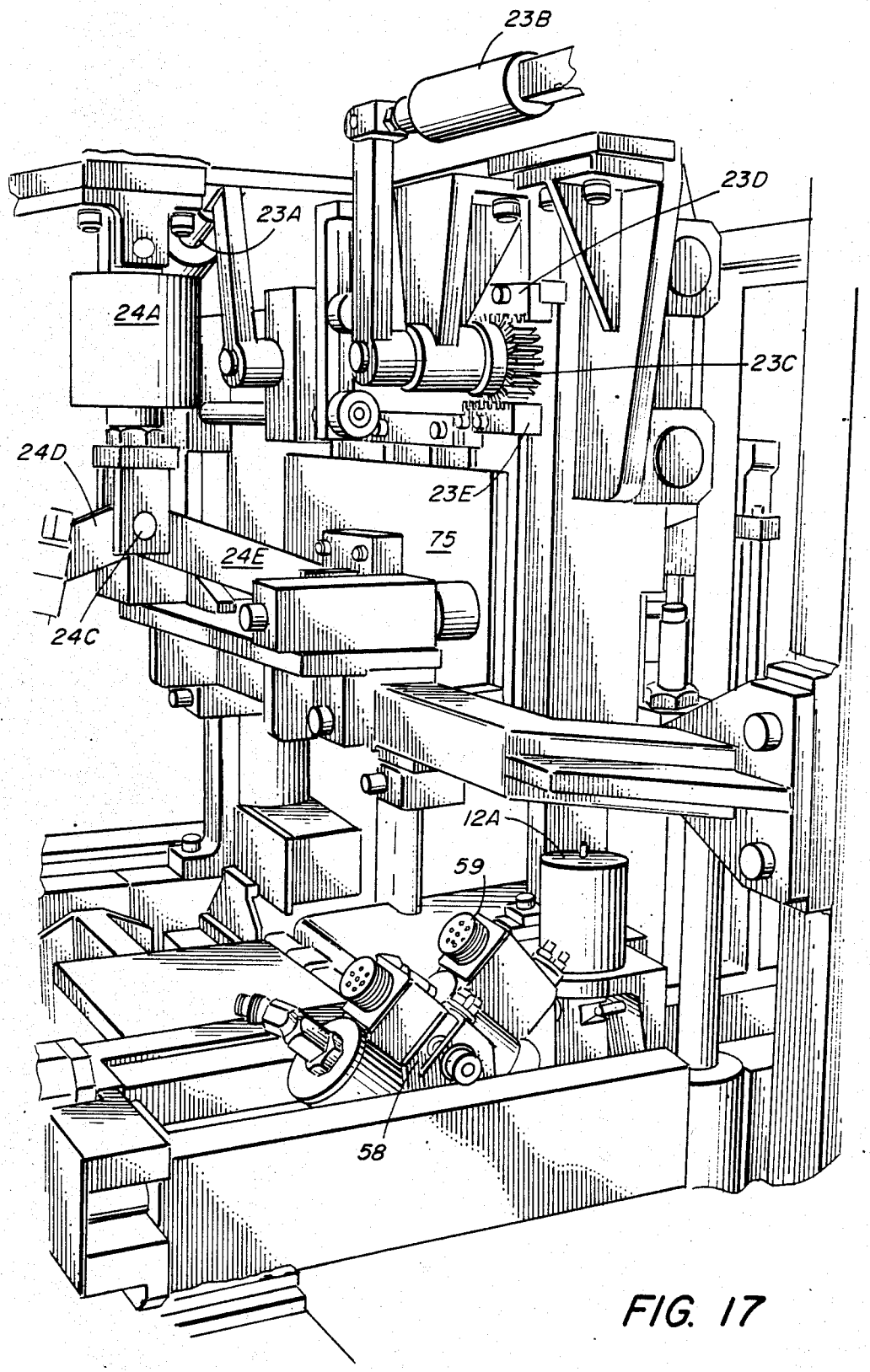
FIG. 17 is an isometric view from the right, rear of the machine of FIG. 7.

To complete the explanation with respect to the blocks in FIG. 2 and shown in later figures, the end 50I of the adhesive tab strikes the arcuate surface 19B of the deflector bar 19A in FIG. 5 to deflect the sealing tab 50E beneath the bottom face 70' of the press fingers 70 as the movable table 51 is raised such that the end 50I of the sealing tab 50E moves slightly longitudinally forwardly (i.e., plus Z-direction) of the machine 101. A plurality of projecting pins 73 extend downwardly (one pin is shown in FIG. 5) from the bottom face 70' of the press fingers 70, the pin(s) 73 are positioned to stop the forward movement of the end 50I of the sealing tab 50E after the tab 50E has moved forwardly a slight distance. The pins 73 are spring loaded (see spring 73A) to extend below the bottom 70' of the press fingers 70. The spring(s) 73A serve to permit the pin 73 to retract into the fingers 70 so that they will not interfere with further operations of the machine 101, particularly as the movable table 57 moves into close proximity to the underside 70' of the finger assembly 70. The photosensor 18 in FIG. 2 senses the top of the side panel 50A, as the table 51 is raised, thereby activating the deflector bar solenoid 19 (see FIG. 2) which activates the solenoid 19B in FIG. 5, which rotates an arm 77 that pivots at 77A clockwise in FIG. 5 to move the deflector bar 19A to the position shown in FIG. 5 and counterclockwise to retract the deflector bar 19A to the right in FIG. 5. (The deflector bar 19A is an elongate member—typically about twelve inches long—extending into the paper in FIG. 5. It is supported at each end by a pair of shafts, one of which, 19C, is shown, that extend and retract with respect to a support, one of which 19D, is shown in FIG. 5. Thus the deflector 19A is moved into the active volume of the machine 101 and withdrawn therefrom.) A limit switch 22 in FIG. 2 indicates when the table 51 has reached its height closely spaced from the bottom 70' of the finger assembly 70 and the upward movement is stopped. Then a side press air valve solenoids 23 in FIG. 2 actuate air cylinder 23B in FIG. 17, causing the fingers 70A and 70B to close toward the center position; another air cylinder 23A in FIG. 17 acuates the fingers 70C–70I to move toward the center position between each pair. The datum-end fingers 70A–70B and one other press finger pair thus squeeze the sides 50A and 50B between respective finger pairs. Then a toggle press air valve solenoid 24 in FIG. 2 actuates the air cylinder 24A in FIG. 1 to press the end parts of the lid together, as before discussed. At that juncture an automatic sequence of events is orchestrated by the controller 10: the air cylinder 24A retracts opening the space 74 to release the lid end; the air cylinders 23A and 22B retract separating the fingers 70A–70I; the air cylinder 62 retracts lowering the table 51 to its initial position about seven or eight inches below the bottom 70' of the fingers 70A–70G; the belt 54 is driven in reverse to remove the lid with its end formed; and the nip rolls 56A and 56B in FIG. 7 rise to allow the formed box part to be removed, reversed and re-introduced to form the other end. The foregoing steps are then repeated to form the other end of the lid or to form the end of another lid.

While figures other than FIG. 1 are referred to in the explanation above, most of that explanation is with reference to FIG. 1. In what now follows most of the explanation is made with reference to FIGS. 7–17. It should be noted that some of the FIGS. 7–17 show a machine with parts omitted. Thus, for example, none shows an outside enclosure. The box labeled 114 in FIG. 11, which contains solenoids 3 (two solenoids), 11 (two solenoids), 12 (two solenoids), 15 (one solenoid), 6 (one solenoid), 17 (one solenoid), 19 (one solenoid), 23 (two solenoids) and 24 (one solenoid), is not shown in any other figure. The finger assembly is shown in FIGS. 6, 7, 8 and 9, but it is omitted from FIGS. 10 and 11, for example, to permit a front view to show machine elements behind the finger assembly 70: e.g., the flat toggle plate 75 in FIGS. 10 and 11. A box lid 50 is shown in FIGS. 8, 9, 10 and 11, but not in some of the other figures.

First, the functioning of the finger assembly 70 is addressed. As above indicated, the finger pair 70A–70B is aligned such that the center position (like 103 in FIG. 4) is about coincident with the plane of the inside surface of the datum end guide 48A. In the machine described here that coincidence (actually the center line is aligned about with the center of the upstanding side 50A) is maintained. The center line or position of a cooperating pair of fingers, e.g., the fingers 70C and 70D in FIG. 4, are aligned such that the center line or center position 103 is at about the center of the upstanding side 50B. Transverse finger positioning (±X-direction in FIG. 13) of the fingers 70C–70D is effected by a stepper motor 4 in FIG. 14 through pulleys 4A and 4B, a timer belt 4C, a threaded shaft 4D into a mechanism 4E which rides on a shaft 4F. Thereafter the finger pair 70A–70B and the further finger pair, e.g., 70C–70D, open from and close toward the center position therebetween, upon actuation of the two side press air valve solenoids 23. The solenoids 23 actuate air cylinders 23A and 23B to close the fingers 70A–70B and the further finger pair, e.g., 70C–70D. The cylinders 23A and 23B in FIG. 17 achieve their actions respectively through a linkage 23A′ and 23A″ in FIG. 14 and rack and pinion devices 23C, 23D and 23E in FIG. 17.

Figure 6:
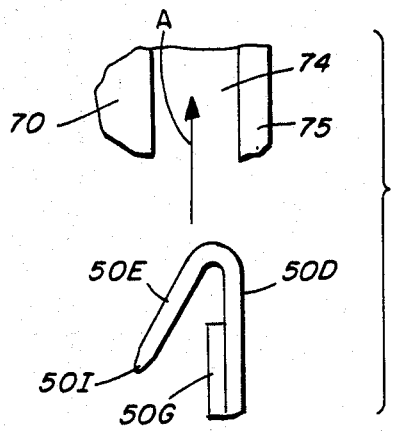
FIG. 6 shows one end of the box blank of FIG. 3 with its end portion partially formed.

It is noted above, that once the end of a box part is received between the toggle plate 75 and the back 70″ of the press finger assembly 70 in FIG. 6, that the space 74 is reduced to press the box parts between the plate 75 and the finger assembly 70. This movement is achieved, as noted before, by the double-acting air cylinder 24A which moves a pivot element 24B down and up in FIG. 13 respectively to move the toggle plate 75 toward the press finger assembly 70 and away therefrom. The mechanical advantage of the links 24D and 24E about a pivot 24C will be understood by workers in this art.

The sequencing of the nip rolls 56A and 56B is discussed in this paragraph. The labels 56A and 56B designate a structure that includes a roller (see 56A in FIG. 16) that presses downward on the bottom 50C of the box 50. The rollers are pressed downward in FIG. 7 by air cylinders 3A and 3B that interact through rack and pinion devices 56C and 56D, respectively, in FIG. 7. The rack and pinion devices convert short strokes of the double-acting air cylinder 3A and 3B to relatively large ±Y-direction movement of the nip rollers 56A and 56B in FIG. 7. The air cylinders 3A and 3B also provide controllable pressure by the rollers onto the bottom 50C. As noted above, the cylinders 3A and 3B serve to remove the nip rollers 56A and 56B from the active region of the machine, once the end of the box part is formed.

It should be apparent that the controller 10 in FIG. 2 is aware of all aspects of the box forming machine herein, including box size. To produce a box part, the controller 10 receives input information regarding the box part to be formed. The controller 10 is programmed to produce a number of box parts of various sizes; so when an input as to size is received, the controller 10 mandates a number of events: the lateral position of the fingers 70C–70I is established; whether one or both of the nozzles 58 and 59 will activated is established; the position of the guide 48A is established; and so forth. The functioning of the various mechanism in the machine are established by the controller 10. Basically, ON-OFF type operations are achieved by double-acting air cylinders, whereas movement of mechanisms through precise linear distances is achieved by stepper motors or servomotors and encoders. The air cylindrs function through pivoting linkages; the electric motors interact through threaded shafts which move active devices to precise positions. For example, the tables 51 and 57 are moved from one location to a predetermined new position by air cylinders; the adhesive applicators, on the other hand, are positioned by the stepper motors (i.e., 7A and 7B in FIG. 16) and transverse positioning of the fingers 70C–70I is achieved by the stepper motor 4, as above noted. The controller 10 in accordance with the present teachings includes a microprocessor; the iterative steps followed by that microprocessor are listed in PASCAL below.

```
{OPERATOR LOADS BOX WITH SIDES FOLDED UP}
{OPERATOR PUSHES START BUTTON}
IF (CementTemp AND CementAir AND SensorAir)
THEN
RotoActL:= TRUE;        {LEFT ROTARY ACTUATOR MOVES LINEARLY INTO POSITION}
MOVACTR;                {RIGHT SIDE ROTARY ACTUATOR MOVES IN TO POSITION}
RotoACT:= FALSE;        {ROTARY ACTUATORS RETURN TO OPEN POSITION}
Idler:= TRUE;           {IDLER ROLL MOVES DOWN INTO POSITION}
DELAY (50);
FEEDIN;                 {NIP ROLL FEED MOTOR (FEED BOX INTO POSITION)}
                        {BOX FEED SENSOR SENSES BOX}
                        {BOX FEED STOPS}
VacHold:= TRUE;         {VACUUM TURNS ON}
RotoACT:= TRUE;         {ROTARY ACTUATORS FOLD FLAPS}
IF NOT SWCOV            {SWCOV IS BOX OR COVER SELECTION SWITCH}
THEN
SELEC:= 1;
ELSE IF SWCOV
THEN
SELEC:= 2;
NOZ:= SELEC;
CASE NOZ OF
1: CEMCOV;              {PROCEDURE TO CEMENT COVERS}
2: CEMBOX;              {PROCEDURE TO CEMENT BOXES}
END;
FoldTable:= TRUE;       {REAR TABLE FOLDS UP MAIN END FLAP}
DELAY (50);
VacHold:= FALSE;        {VACUUM TURNS OFF}
ACTHOME;                {RIGHT ACTUATOR RETURNS TO HOME POSITION}
RotoActL:= FALSE;       {LEFT ACTUATOR RETURNS TO HOME POSITION}
DELAY (50);
Table:= TRUE            {MAIN TABLE STARTS TO ELEVATE}
DeflectBar:= TRUE;      {TAB DEFLECTOR BAR EXTENDS}
IF BoxTop               {TOP OF BOX SENSOR SENSES BOX}
THEN
DeflectBar:= FALSE;     {TAB DEFLECTOR RETRACTS}
IF TableHome            {MAIN TABLE IN UP POSITION SENSOR}
THEN
Clamp:= TRUE;           {Clamp FINGERS CLOSE}
IF Clamped              {ClampS CLOSED SENSOR}
THEN
```

-continued

```
Toggle:= TRUE;          {REAR TOGGLE PRESS IS ACTUATED}
DELAY (500);
Toggle:= FALSE;         {REAR TOGGLE RETRACTS}
DELAY (100);
Clamp:= FALSE;          {ClampS OPEN}
FoldTable:= FALSE;      {REAR TABLE RETURNS TO LEVEL POSITION}
IF NOT BoxTop           {TOP OF BOX SENSOR SEES NO BOX}
THEN
DELAY (100);
FEEDOUT;                {NIP ROLL FEED MOTOR (EJECT BOX}
Idler:= FALSE;          {IDLER ROLL LIFTS OUT OF WAY}
END;
```

Modifications of the invention herein disclosed will occur to persons skilled in the art and all such modifications are deemed to be within the scope of the invention as defined by the appended claims.

What is claimed is:

1. A machine having a longitudinal direction, a transverse direction and a datum end parallel to the longitudinal direction to form a box part from a flat box blank comprising two sides, a bottom and, at each of front and back end of the box blank, an end flap supporting a cantilevered sealing tab and two side tabs, one side tab being supported by each of the two sides, the connection between the end flap and the bottom constituting an inside fold line, that comprises:

a planar movable table having a front and a back, extending in the longitudinal direction to receive the box blank;

a nip roll feed mechanism positioned with respect to the movable table and operable to engage the box blank and to move the box blank longitudinally rearwardly along the table surface to a point of register of the inside fold line of the box blank with the back of the table, the end flap, including the sealing tab, moving, cantilever fashion beyond the back of the movable table;

a planar folding table to receive the end flap and the sealing tab;

a pair of side guides to secure said sides of the box blank and to guide the box blank in its rearward travel;

end flap folding mechanisms that serve to fold tab portions attached to the box blank sides through ninety degrees to a position parallel to said fold line;

adhesive applicator means adapted to apply adhesive to the sealing tab;

drive means operable to fold the folding table from a position such that the plane of the folding table is parallel to the plane of the movable table to a position perpendicular to the movable table to fold in the end flap through ninety degrees;

a finger assembly comprising a plurality of press fingers (or plates) having a front and a back disposed perpendicularly above and separated from the movable table at the back of the movable table, the back of the press fingers forming a substantially planar surface which is parallel to said fold line and in the plane of the fold line, the press fingers having a bottom face disposed parallel to the plane of the movable table, the press fingers being movable transversely from an initial position wherein immediately adjacent press fingers are separated transversely from one another to receive a side of a box part to an another position wherein the immediately adjacent press fingers are closed upon one another to close the side therebetween, said immediately adjacent press fingers being closed toward each other to a central position which assures that the sides of the formed box part are perpendicular to the box part bottom;

drive means to raise the movable table toward and into close proximity of the bottom face of the press fingers;

a deflector that deflects the sealing tab beneath the bottom face of the press fingers as the movable table is raised;

a toggle press plate disposed parallel to and slightly separated from the back of the press fingers such that the sealing tab, now folded onto the inner surface of the side tabs, captivates the side tabs;

means to close the press fingers toward one another to square the sides of the box; and toggle press means that move the toggle press plate to squeeze the sealing tab, end flap and side tabs at the back end of the box part into firm engagement with one another to adhere said sealing tab, end flap and side tabs to one another.

2. A machine according to claim 1 in which the press fingers function in pairs, in which the finger assembly comprises a plurality of finger pairs that includes a datum-end finger pair disposed at the datum-end of the machine and at least one further finger pair spaced transversely from the datum-end finger pair and that further includes a finger assembly mechanism operatively coupled to the finger assembly and adapted to move the at least one finger pair transversely of the movable table to accommodate box blanks of differing sizes, said central position being thereby changed to be located in registration with one of the box blank sides.

3. A machine according to claim 1 that includes a datum end guide and a movable guide spaced transversely from the datum end guide, respectively to receive one side of the box blank folded inwardly through ninety degrees and the other side of the box blank folded inwardly through ninety degrees and in which the press fingers function in pairs, said machine comprising a plurality of finger pairs that includes a datum-end finger pair and at least one further finger pair spaced transversely from the datum end finger pair.

4. A machine according to claim 3 that includes means to move the fingers of each finger pair toward and away from each other, the fingers of a spaced pair being moved toward each other to meet at said central position.

5. A machine according to claim 4 that includes a finger assembly positioning mechanism operatively coupled to the finger assembly and adapted to move the at least one further finger pair transversely of the movable table to accommodate different sizes of box blanks, whereby said central position between said at least one further finger pair is moved to align (or register) with said other side of the box blank such that, when movable table is moved into close proximity of the bottom face of the press fingers, said one side of the box blank is received between fingers of the datum-end finger pair and said other side of the box blank is received between the fingers of said at least one further finger pair.

6. A machine according to claim 5 in which said means to move the at least one further finger pair is effective to move each finger of each pair in unison, away and toward the other finger of the pair respectively to receive a side panel of a box part and to squeeze the side panel of the box part between the fingers of the finger pair that receives the side panel of the box part and in which the finger assembly positioning mechanism is connected to move said plurality of further finger pairs in unison transversely of the movable table.

7. A machine according to claim 1 in which the nip roll feed mechanism includes a belt mechanism including a belt drive and a belt, which belt moves along the surface of the movable table, engages the underside of the box blank and is driven by the belt drive to move the box blank in a direction parallel to the top of the surface of the movable table.

8. A machine according to claim 7 in which the nip roll feed mechanism includes a first roller that passes downward upon the box blank whereby the box blank is pressed onto the belt by the first roller.

9. A machine according to claim 8 wherein the first roller is disposed to press one side of the box blank onto the belt and wherein another roller, spaced transversely of the first roller with respect to the box blank, serves as a follower that presses the box blank toward the surface of the movable table.

10. A box forming machine having a longitudinal direction, a transverse direction and a datum side parallel to the longitudinal direction to form an end of a unit of a box from a flat box blank comprising two sides and a bottom and, at each said end, an end flap supporting a cantilevered sealing tab and two side tabs, one supported by each of the two sides, the connection between the end flap and the bottom constituting a fold line, which machine comprises:

a planar movable table to receive the box blank;

a nip roll feed mechanism comprising a continuous-loop belt positioned to coincide with the plane of the movable table, said belt being operable to engage the box blank and to move the box blank rearwardly along the table surface to a point of register of the fold line of the box blank with the back of the table, the end flap, including the sealing tab moving, cantilever fashion, beyond the back of the movable table;

a planar folding table to receive the end flap and the sealing tab;

a pair of side guides to secure the two sides of the box blank and to guide the box blank in its rearward travel;

an end flap folding mechanism that serves to fold the two side tabs attached to the box blank sides through ninety degrees to a position essentially parallel to said fold line;

adhesive applicator means adapted to apply adhesive to the sealing tab;

drive means operable to fold the folding table from a position such that the plane of the folding table is in the plane of the movable table to a position such that the plane of the folding table is perpendicular to the plane of the movable table to fold the end flap through ninety degrees; and a finger assembly comprising a plurality of press fingers disposed above and separated from the movable table at the back of the movable table, the back of the press fingers forming a surface which is parallel to said fold line, the press fingers having a bottom face disposed parallel to the plane of the movable table, the press fingers being movable transversely from an initial position wherein the press fingers are separated transversely from one another to an other position wherein the press fingers are closed toward one another with a box blank side therebetween, adjacent press fingers being closed toward each other to a central position which assures that the sides of the formed box unit are substantially perpendicular to the box unit bottom.

11. A machine according to claim 10 that further includes drive means to raise the movable table toward and into close proximity to the bottom face of the press fingers.

12. A machine according to claim 11 that further includes a deflector that deflects the sealing tab beneath the bottom face of the press fingers as the movable table is raised such that the end of the sealing tab moves longitudinally forwardly of the machine, there being projecting pins that extend downwardly from the bottom face of the press fingers positioned to stop the forward movement of the end of the sealing tab after the tab has moved forwardly a slight distance, said pins being spring loaded to extend below the bottom of the press fingers, the loading springs serving, however, to enable the pins to retract into the fingers so that they will not interfere with further machine operations.

13. A machine according to claim 12 that further includes a toggle press plate disposed parallel to and slightly separated from the back of the press fingers such that the sealing tab, now folded onto the inner surface of the side tabs, captivates the two side tabs.

14. A machine according to claim 13 that further includes means to close the press fingers toward one another to square the sides of the box unit.

15. A machine according to claim 14 that further includes toggle press means that moves the toggle press plate to squeeze the box elements of the end of the box unit to one another to adhere said box elements to one another.

16. A machine according to claim 10 that includes a datum side guide to receive one of the two sides of the box blank and an adjustable side guide to receive the other of the two sides of the box blank, which two sides have been previously moved through ninety degrees to be substantially diagonal to said bottom, whereby the two sides are moved in close engagement with the respective side guide.

17. A machine according to claim 16 in which the nip roll feed mechanism includes a belt mechanism including a belt drive and a belt, which moves along the surface of the movable table, engages the underside of the box blank and is driven by the belt drive to move the box blanks in a direction parallel to and along the top surface of the movable table.

18. A machine according to claim 17 in which the nip roll feed mechanism includes a first roller that presses downward upon the box blanks, whereby the box blank is pressed onto the belt by the first roller.

19. A machine according to claim 18 in which the first roller is disposed to press one side of the box blank onto the roller and in which another roller, spaced transversely of the first roller with respect to the box blank, serves as a roller that presses a spaced portion of the box blank toward the surface of the movable table.

20. A machine according to claim 15 in which each of the press fingers is a rectilinear plate, in which the press fingers are mechanically interconnected to act in pairs, and which includes a pair of datum fingers located at the datum side of said machine and a further pair of fingers located at the location of the adjustable side guide, each finger of each pair being movable toward and away fom the other finger of the pair such that, when the fingers are separated from one another one of said two sides can be moved between the datum pair of fingers and the other of said two sides can be moved between the fingers of said further pair.

21. A machine according to claim 20 that includes means to move each finger of the pair toward and away from the other finger of the pair in a direction substantially orthogonal to the direction of travel of the box blank in the machine.

22. A machine according to claim 21 in which the backs of the press fingers form a planar back surface and the bottoms of the press fingers form a planar bottom surface, which machine includes means to raise the movable table toward the planar bottom surface.

23. A machine according to claim 21 that further includes a deflector bar with an arcuate surface to receive the end of the sealing tab which, as the movable table raises, is bent forwardly and into contact with the planar bottom surface of the fingers.

24. A machine according to claim 23 having a plurality of pins or like members projecting downward from the fingers to receive and stop movement of the sealing tab toward the front of the fingers whereby the sealing tab is folded toward the end flap with continuing upward movement of the movable table with the two side tabs therebetween to form an end on the box blank, which end moves, as the movable table is raised further, into the separation between the toggle press plate and the back of the press fingers and is subsequently pressed to adhere all parts of the end of the box blank to one another.

25. A machine to form a unit of a box from a blank comprising two sides, a bottom and, at each end, an end flap supporting a cantilevered sealing tab, and two side tabs, one projecting from each of the two sides, the connection between each end flap and the bottom constituting a fold line, which machine comprises:

a table having a surface to receive the blank;

means to move the blank along the surface of the table;

a finger assembly comprising at least two pairs of press fingers adjacent to the table but initially spaced therefrom, the press fingers being movable between two alternate stable positions wherein the fingers of a pair are spaced from one another and closed upon one another respectively to receive a folded side of the blank and to close upon that side;

means to fold the two side tabs inwardly and toward each other;

means to apply adhesive to the sealing tab;

means to fold the end flap inwardly;

means to fold the sealing tab inwardly and toward the inner surface of the end flap with the two side tabs sandwiched between the sealing tab and the end flap;

means to close the space between the press fingers and the table thereby to move one of the said two sides between each of the spaced finger pairs;

means to close the spaced fingers of each pair toward the other finger of the pair to close upon the side therebetween; and means to press the sealing tab and the end flap toward one another with the two side tabs pressed therebetween to adhere these last-named parts to one another, whereby an end is formed on said unit.

26. A machine to form a unit of a box from a blank comprising two sides, a bottom and, at each end, an end flap supporting a cantilevered sealing tab, two side tabs, one projecting from each of the two sides, the connection between each end flap and the bottom constituting a fold line, which machine comprises:

a table having a surface to receive the blank;

a finger assembly comprising at least two pairs of press fingers adjacent to the table but initially spaced therefrom, the press fingers being movable between two alternate stable positions wherein the fingers of a pair are spaced from one another and closed upon one another respectively to receive a folded side of the blank and to close upon that side;

means to fold the two side tabs inwardly and toward each other;

means to apply adhesive to the sealing tab;

means to fold the end flap inwardly;

means to fold the sealing tab inwardly and toward the inner surface of the end flap with the two side tabs sandwiched between the sealing tab and the end flap;

means to close the space between the press fingers and the table thereby to move one of the said two sides between each of the spaced finger pairs;

means to close the spaced fingers of each pair toward the other finger of the pair to close upon the side therebetween; and means to press the sealing tab and the end flap toward one another with the two side tabs pressed therebetween to adhere these last-named parts to one another, whereby an end is formed on said unit.

27. A box forming machine to form an end of a unit of a box from a flat box blank comprising two sides, a bottom, an end flap at each said end supporting a cantilevered sealing tab, and two side tabs, one supported by each of the two sides, the connection between the end flap and the bottom constituting a fold line, which machine comprises:

a receiving table having a surface to receive the blank;

a folding table have a surface to receive the end flap and the sealing tab;

a pair of side guides to secure the two sides of the box blank and to guide the box blank along the receiving table;

an end flap folding mechanism that serves to fold the two side tabs attached to the box blank sides through ninety degrees to a position essentially parallel to said fold line;

adhesive applicator means adapted to apply adhesive to the sealing tab;

drive means operable to fold the folding table from a position such that the surface of the folding table is in the plane of the surface of the receiving table to a position such that the surface of the folding table is perpendicular to the surface of the receiving table to fold the end flap through ninety degrees; and a finger assembly comprising a plurality of press fingers separated from the receiving table at the back of the receiving table, the back of the press fingers forming a surface which is parallel to said fold line, the press fingers having a face disposed substantially parallel to the surface of the receiving table, the press fingers being movable transversely from one another from a position wherein the fingers are spaced from one another to another position wherein the press fingers are closed toward one another with a box blank side therebetween, adjacent press fingers being closed toward each other to a central position which assures that the sides of the formed box unit are substantially perpendicular to the box unit bottom.

28. A method of forming a unit of a box from a blank comprising two sides, a bottom and, at each end, an end flap supporting a cantilevered sealing tab, and two side tabs, one projecting from each of the two sides, the connection between each end flap and the bottom constituting a fold line, which method comprises:

receiving the blank on a table having a surface to receive the blank;

moving the blank along the surface of the table;

folding the two side tabs inwardly and toward each other;

folding the end flap inwardly;

folding the sealing tab inwardly and toward the inner surface of the end flap with the two side tabs sandwiched between the sealing tab and the end flap;

introducing the sides to a finger assembly comprising at least two pairs of press fingers adjacent to the table but initially spaced therefrom, the press fingers being movable between two alternate stable positions wherein the fingers of a pair are spaced from one another and closed upon one another respectively to receive a folded side of the blank and to close upon that side;

closing the space between the press fingers and the table thereby to move one of the said two sides between each of the spaced finger pairs;

closing the spaced fingers of each pair toward the other finger of the pair to close upon the side therebetween; and closing the sealing tab and the end flap toward one another with the two side tabs pressed therebetween to adhere these last-named parts to one another, whereby an end is formed on said unit.

* * * * *